US006969923B2

(12) United States Patent
Kitagawa

(10) Patent No.: US 6,969,923 B2
(45) Date of Patent: Nov. 29, 2005

(54) ENGINE START CONTROL DEVICE, ENGINE START CONTROL METHOD AND RECORDING MEDIUM HAVING PROGRAM RECORDED THEREON FOR IMPLEMENTING ENGINE START CONTROL METHOD

(75) Inventor: Takumi Kitagawa, Owariasahi (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 126 days.

(21) Appl. No.: 10/477,942

(22) PCT Filed: Feb. 20, 2003

(86) PCT No.: PCT/JP03/01893

§ 371 (c)(1),
(2), (4) Date: Nov. 18, 2003

(87) PCT Pub. No.: WO03/083289

PCT Pub. Date: Oct. 9, 2003

(65) Prior Publication Data

US 2004/0104579 A1 Jun. 3, 2004

(30) Foreign Application Priority Data

Apr. 3, 2002 (JP) ..... 2002-100875

(51) Int. Cl.[7] ..... F02N 11/00

(52) U.S. Cl. ..... 290/36 R; 290/1 R; 290/31; 290/40; 290/28; 290/27; 290/47; 290/38 A; 322/125; 318/148; 318/376

(58) Field of Search ..... 290/36 R, 1 R, 290/31, 40, 28, 27, 38 A, 38 R, 47; 322/1, 25; 318/148, 376

(56) References Cited

U.S. PATENT DOCUMENTS

| | | | | | |
|---|---|---|---|---|---|
| 4,316,095 | A | * | 2/1982 | Laffoon | 290/38 R |
| 4,862,010 | A | | 8/1989 | Yamamoto | |
| 5,982,045 | A | * | 11/1999 | Tabata | 290/17 |
| 6,153,942 | A | * | 11/2000 | Roseman | 290/47 |
| 6,323,562 | B1 | * | 11/2001 | Renner | 290/38 A |
| 6,364,042 | B1 | * | 4/2002 | Joachim | 180/65.2 |
| 6,373,206 | B1 | * | 4/2002 | Morimoto et al. | 318/139 |
| 6,396,161 | B1 | * | 5/2002 | Crecelius et al. | 290/36 R |

FOREIGN PATENT DOCUMENTS

| | | |
|---|---|---|
| JP | U 63-154773 | 10/1988 |
| JP | B2 7-6469 | 1/1995 |
| JP | A 11-193767 | 7/1999 |

* cited by examiner

*Primary Examiner*—Nicholas Ponomarenko
*Assistant Examiner*—Iraj A. Mohandesi
(74) *Attorney, Agent, or Firm*—Oliff & Berridge, PLC

(57) ABSTRACT

An engine start system includes a starter starting an engine, a starter drive relay controlling the starter and an engine ECU connected to a starter switch for controlling on/off of the starter drive relay based on a predetermined start condition. The engine start system further includes a normally closed relay connected to the starter switch, the engine ECU and the starter for establishing a de-energized state between the starter switch and the starter upon energization from the engine ECU to an exciting coil and establishing an energized state between the starter switch and the starter upon de-energization of the exciting coil. The engine ECU includes a circuit energizing the exciting coil of the normally closed relay upon turn-on of the engine ECU.

16 Claims, 5 Drawing Sheets

ENGINE START CONTROL DEVICE, ENGINE START CONTROL METHOD AND RECORDING MEDIUM HAVING PROGRAM RECORDED THEREON FOR IMPLEMENTING ENGINE START CONTROL METHOD

TECHNICAL FIELD

The present invention relates to a start control device for an engine of a vehicle. More particularly, the present invention relates to a start control device capable of starting the engine even if a computer controlling the start of the engine is inoperative.

BACKGROUND ART

An engine of a vehicle is usually started by operation of an ignition switch. The ignition switch is operated by an ignition key inserted into a key slot and then turned to a predetermined position. The ignition switch has an off (OFF) position for insertion and removal of the ignition key, an accessory (ACC) position for energizing electrical accessories, for example, car audio system and the like, an on (IG-ON) position for energizing an ignition system of the engine, and an engine start (ST) position for energizing a starter thereby starting the engine. The ignition key in the engine start position returns to the on position unless a driver applies force to the key to hold the key in the engine start position. The ignition key in any of other positions stays at the original position even if the driver releases the key.

Recently, control of the start of the engine as mentioned above has been exercised by a computer which generally controls a start system. Japanese Patent Publication No. 7-6469 (Japanese Patent Laying-Open No. 63-297767, corresponding to U.S. Pat. No. 4,862,010) discloses an engine start method by means of a computer.

The disclosed engine start method includes the steps of: starting a current supply to an exciting coil of an electromagnet switch upon receiving an engine start instruction signal from an ignition switch and continuously closing the electromagnet switch; checking various conditions to detect whether or not there is a trouble with initiation of the start of the engine after the current supply to the exciting coil of the electromagnet switch is started and before the electromagnet switch is closed; stopping the current supply to the exciting coil of the electromagnet switch if there is a trouble; starting the engine by a current supply to a starter upon the closure of the electromagnet switch; checking various conditions to detect whether or not there is a trouble with continuation of the start of the engine after the electromagnet switch is closed and before the start of the engine is completed; stopping the current supply to the exciting coil of the electromagnet switch if there is a trouble; and stopping the current supply to the exciting coil of the electromagnet switch when it is determined that the start of the engine is completed.

According to the disclosed engine start method, in starting the engine, namely in the period from the start of the current supply to the electromagnet switch to the start of the engine, various conditions are checked by the computer to detect whether or not there is a trouble with the initiation of the start of the engine and the continuation of the start. If any trouble is found by the check, the supply of the exciting current is stopped until the start of the engine is completed. The process is thus efficient and, for example, it is possible to prevent an automobile from suddenly moving forward when the shift lever is operated in a cranking process and thereby achieve a safe automatic start.

However, the disclosed engine start method as described above has the following problems. The starter for starting the engine of the vehicle is supplied with electric power from a battery installed in the vehicle. The starter cranks the engine which has been stopped so as to start the engine. Therefore, the starter requires a large starting current. Then, as a computer is supplied with electric power from the same battery installed in the vehicle, a supply voltage from the vehicle-installed-battery to the computer could be lower than an operating voltage of the computer when the starter is rotating. In this situation, the above-described engine start method cannot be used to start the engine. In order to avoid such a situation, the voltage which ensures the operation of the computer may be lowered. This approach, however, requires a considerably high reliability of the computer, resulting in a cost increase.

It is thus an object of the present invention to provide an engine start control device and a control method by which an engine can be started even if a computer of an engine start system is inoperative.

It is another object of the present invention to provide an engine start control device and a control method of low cost by which an engine can be started even if a computer of an engine start system is inoperative.

DISCLOSURE OF THE INVENTION

An engine start control device according to the present invention is an engine start control device including a motor for starting an engine of a vehicle, a motor control relay making a switch between supply and stop of electric power to the motor and a control circuit connected to an engine starter switch and controlling opening/closing of the motor control relay based on a predetermined start condition. The start control device includes a normally closed relay connected to the engine starter switch, the control circuit and the motor, establishing a de-energized state between the engine starter switch and the motor upon energization from the control circuit to an exciting coil and establishing an energized state between the starter switch and the motor upon de-energization of the exciting coil. The control circuit includes control means for exercising control, based on a predetermined condition, to energize the exciting coil of the normally closed relay.

The motor which starts the engine as well as the control circuit are supplied with electric power from a power source (battery) installed in the vehicle. When the voltage supplied to the control circuit is equal to or higher than a predetermined voltage, the control circuit normally operates. When the engine is started, the motor consumes large electric power so that the voltage supplied to the control circuit temporarily decreases. At this time, the control circuit temporarily becomes inoperative. Upon satisfaction of a predetermined condition, for example, upon start of supply of the electric power from the power source, the control circuit energizes the exciting coil of the normally closed relay to establish the de-energized state between the engine starter switch and the motor. In this situation, the control circuit controls the motor based on a predetermined start condition. When a start instruction is output from the control circuit to the motor, power is supplied from the power source to the motor, which could result in a decrease of the voltage supplied to the control circuit. In this case, the energization to the exciting coil is stopped so that the energized state is established between the engine starter switch and the motor.

At this time, as the energized state is established between the engine starter switch and the motor, the motor is kept supplied with electric power even if the control circuit does not normally operate. When the voltage is thereafter supplied to the control circuit as before, the exciting coil of the normally closed relay is energized. Then, the control circuit controls the motor based on the start condition and, the starting operation is completed upon a complete explosion of the engine. Moreover, even if the control circuit becomes completely inoperative, the exciting coil is de-energized and the energized state is established between the engine starter switch and the motor. Thus, the engine can be started, without the control circuit, by switching between supply and stop of electric power to the motor by the engine starter switch. In this way, the engine start control device can be provided at a low cost that is capable of starting the engine even when the computer of the engine start system is inoperative.

More preferably, the control circuit includes a circuit which enters an inoperative state when a voltage supplied from a power source installed in the vehicle drops below a predetermined voltage, and accordingly energization from the control circuit to the exciting coil is stopped.

The control circuit and the motor are supplied with electric power from the power source installed in the vehicle. When the voltage supplied from the power source drops below a voltage which ensures the operation, the control circuit enters the inoperative state. The inoperative state of the control circuit causes energization to the exciting coil to stop so that the energized state is established between the engine starter switch and the motor. Accordingly, the engine starter switch can make a switch between supply and stop of electric power to the motor and thereby start the engine.

More preferably, the control circuit includes means for exercising control to energize the exciting coil of the normally closed relay upon satisfaction of a condition that supply of electric power from a power source installed in the vehicle to the control circuit is started.

When supply of electric power from the power source is started (e.g. the ignition switch is turned from the accessory position to the on position), the control circuit energizes the exciting coil of the normally closed relay to establish a de-energized state between the engine starter switch and the motor. In this situation, the engine can be started, not by the engine starter switch, but the control circuit which makes a switch between supply and stop of electric power to the motor.

More preferably, a switching circuit of the engine starter switch is closed so long as force is applied to the switch.

The engine starter switch is a switch which has a momentary-on contact and the contact is closed so long as the driver applies force. When the control circuit enters the inoperative state, energization to the exciting coil is stopped so that the energized state is established between the engine starter switch and the motor. In this case, the driver turns on the momentary-on contact so as to start supply of electric power to the motor. Knowing start of the engine from the engine sound and vibration, the driver lessen the force to turn off the momentary-on contact and thereby stop supply of electric power to the motor. In this way, the engine can normally be started.

More preferably, the normally closed relay is incorporated in the control circuit.

Through the incorporation of the normally closed relay in the control circuit, the whole size of the control circuit can be reduced.

An engine start control method according to another aspect of the present invention is an engine start control method of an engine start control device including a motor for starting an engine of a vehicle, a motor control relay making a switch between supply and stop of electric power to the motor, a control circuit connected to an engine starter switch and controlling opening/closing of the motor control relay based on a predetermined start condition, and a normally closed relay connected to the engine starter switch, the control circuit and the motor, establishing a de-energized state between the engine starter switch and the motor upon energization from the control circuit to an exciting coil and establishing an energized state between the starter switch and the motor upon de-energization of the exciting coil. The start control method includes the step of exercising control, based on a predetermined condition, to energize the exciting coil of the normally closed relay.

In the step of exercising control to energize the exciting coil of the normally closed relay, upon satisfaction of a predetermined condition, for example, upon start of supply of the electric power from the power source, the exciting coil of the normally closed relay is energized to establish the de-energized state between the engine starter switch and the motor. In this situation, the control circuit controls the motor based on a predetermined start condition. When a start instruction is output from the control circuit to the motor, power is supplied from the power source to the motor, which could result in a decrease of the voltage supplied to the control circuit. In this case, the energization to the exciting coil is stopped so that the energized state is established between the engine starter switch and the motor. At this time, as the energized state is established between the engine starter switch and the motor, the motor is kept supplied with electric power even if the control circuit does not normally operate. When the voltage is thereafter supplied to the control circuit as before, the exciting coil of the normally closed relay is energized. Then, the control circuit controls the motor based on the start condition and, the starting operation is completed upon a complete explosion of the engine. Moreover, even if the control circuit becomes completely inoperative, the exciting coil is de-energized and the energized state is established between the engine starter switch and the motor. Thus, the engine can be started, without the control circuit, by switching between supply and stop of electric power to the motor by the engine starter switch. In this way, the engine start control method can be provided at a low cost by which the engine can be started even when the computer of the engine start system is inoperative.

More preferably, the step of exercising control to energize the exciting coil of the normally-closed relay includes the step of exercising control to energize the exciting coil upon satisfaction of a condition that supply of electric power from a power source installed in the vehicle to the control circuit is started.

In the step of exercising control to energize the exciting coil of the normally closed relay, when supply of electric power from the power source is started (e.g. the ignition switch is turned from the accessory position to the on position), the exciting coil of the normally closed relay is energized to establish a de-energized state between the engine starter switch and the motor. In this situation, the engine can be started, not by the engine starter switch, but the control circuit which makes a switch between supply and stop of electric power to the motor.

A recording medium according to still another aspect of the present invention has a program recorded thereon for allowing a computer to implement the above-described engine start control method.

Accordingly, a program for implementing the engine start control method can be provided, at a low cost, by which the engine can be started even when the computer of an engine start system is inoperative.

BEST MODES FOR CARRYING OUT THE INVENTION

Figure 1:
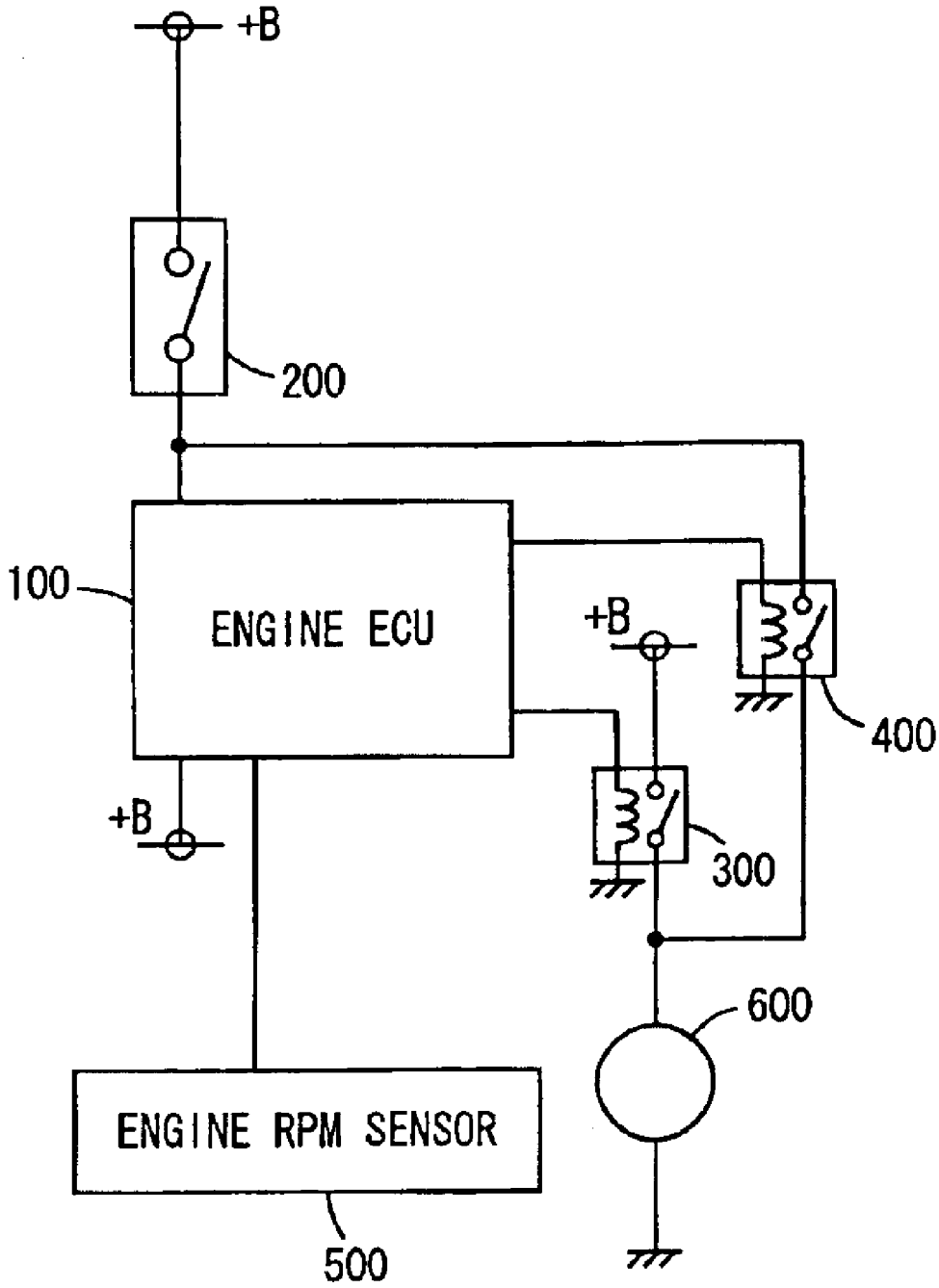
FIG. 1 is a control block diagram of an engine start system according to a first embodiment of the present invention.

Embodiments of the present invention are hereinafter described with reference to the drawings. In the following description, like reference characters denote like components. The components also have the same name and the same function. Accordingly, detailed description of these components is not repeated here.

First Embodiment

An engine start system according to a first embodiment of the present invention is now described. As shown in FIG. 1, the engine start system includes an engine ECU (Electronic Control Unit) 100 controlling start of an engine and rotation of the engine, a starter switch 200 connected to engine ECU 100, a starter drive relay 300 connected to engine ECU 100, a starter 600 connected to starter drive relay 300, and an engine rpm sensor 500 connected to engine ECU 100.

Starter switch 200 enters a switch-on state as a key is turned from the on position to the engine start position of an ignition switch. Starter switch 200 has a momentary-on contact which is turned on only when a driver holds the key in the engine start position.

Engine ECU 100 makes a determination, when the contact of starter switch 20 is turned on, as to an engine start condition stored in advance in an internal memory of engine ECU 100. If the engine is to be started, an exciting circuit of starter drive relay 300 is energized. The energization of the exciting circuit of starter drive relay 300 causes electric power supplied from a battery to be supplied to starter 600. The electric power supplied to starter 600 then causes starter 600 to rotate and thereby crank the engine.

Cranking of the engine is thus started and then rotation of the engine is started. According to an engine rpm detected by engine rpm sensor 500, it is determined whether or not the engine is in a complete explosion state.

The engine rpm detected by engine rpm sensor 500 is input to engine ECU 100. If the input engine rpm is equal to a predetermined rpm or higher, engine ECU 100 determines that the engine is in the complete explosion state. Determining that the engine is in the complete explosion state, engine ECU 100 stops energization to the exciting circuit of starter drive relay 300. Accordingly, rotation of starter 600 stops and this engine start is completed. Engine ECU 100 is supplied with electric power from the battery which supplies electric power to starter 600.

Engine ECU 100 stops operating when the voltage is lower than a predetermined voltage which ensures the operation. At this time, the energization from engine ECU 100 to the exciting circuit of starter drive relay 300 is stopped.

The engine start system according to this embodiment includes, in addition to the above-described components, a normally closed relay 400 connected to engine ECU 100, starter switch 200 and starter 600. An exciting circuit of normally closed relay 400 is energized by engine ECU 100. When this exciting circuit is energized by engine ECU 100, normally closed relay 400 establishes a de-energized state between starter switch 200 and starter 600 (i.e. normally closed relay 400 is in an off state). When the energization from engine ECU 100 to the exciting circuit is stopped, normally closed relay 400 establishes an energized state between starter switch 200 and starter 600 (i.e. normally closed relay 400 is in an on state).

Figure 2:
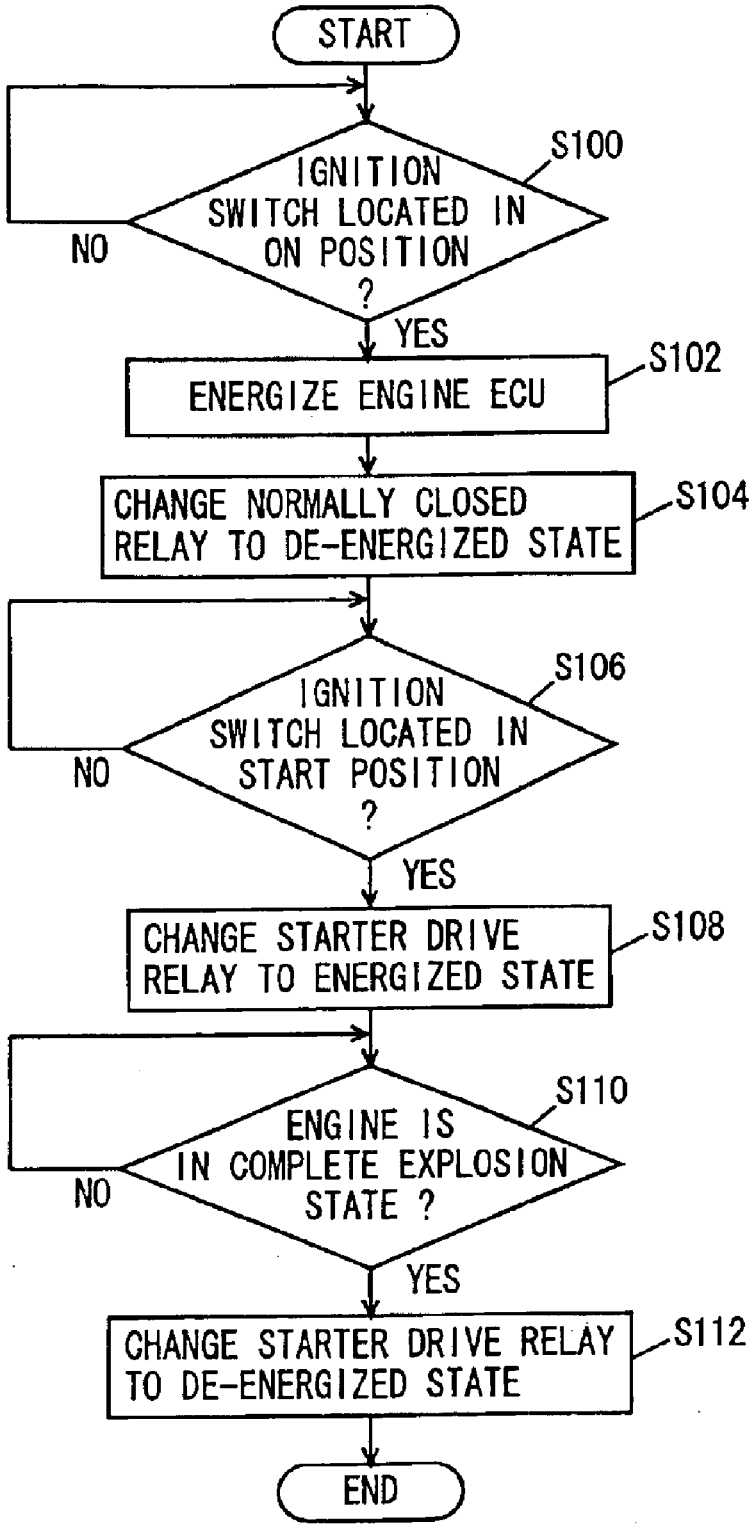
FIG. 2 is a flowchart showing a control structure of a program executed by an engine ECU of the engine start system according to the first embodiment of the present invention.

Referring to FIG. 2, a program executed by the engine start system according to this embodiment has a control structure as described below.

In step (hereinafter "step" is abbreviated as "S") 100, a main computer of the vehicle determines whether or not the ignition switch is turned to the on position. If the ignition switch is in the on position (YES in S100), this process proceeds to S102. If not (NO in S100), the process returns to S100.

In S102, the main computer of the vehicle turns on a main relay of the battery to start energization from the battery to engine ECU 100. In S104, engine ECU 100 changes normally closed relay 400 from an energized state to a de-energized state. In other words, engine ECU 100 starts energization to the exciting circuit of normally closed relay 400.

In S106, engine ECU determines whether or not the ignition switch is turned to the engine start position. This determination is made according to whether or not starter switch 200 enters an on state. If the ignition switch is in the engine start position (YES in S106), the process proceeds to S108. If not (NO in S106), the process returns to S106 to wait until the ignition switch is turned to the engine start position.

In S108, engine ECU 100 changes the state of starter drive relay 300 to an energized state. Namely, engine ECU 100 starts energization to the exciting circuit of starter drive relay 300.

In S110, engine ECU 100 determines whether or not the engine is in the complete explosion state. This determination is made according to whether or not an engine rpm input from engine rpm sensor 500 is equal to or higher than a predetermined rpm (e.g. about an idling rpm). If the engine is in the complete explosion state (YES in S110), the process proceeds to S112. If not (NO in S110), the process returns to S110.

In S112, engine ECU 100 changes the state of starter drive relay 300 to a de-energized state. Namely, engine ECU 100 stops the energization to the exciting circuit of starter drive relay 300.

The engine start system according to this embodiment operates as described below based on the above-described structure and flowchart.

A driver of the vehicle turns the ignition switch to the on position (YES in S100). Then, engine ECU 100 is supplied with power from the battery (S102). At this time, the voltage supplied to engine ECU 100 is higher than an ECU reset voltage as shown in FIG. 3.

Figure 4:
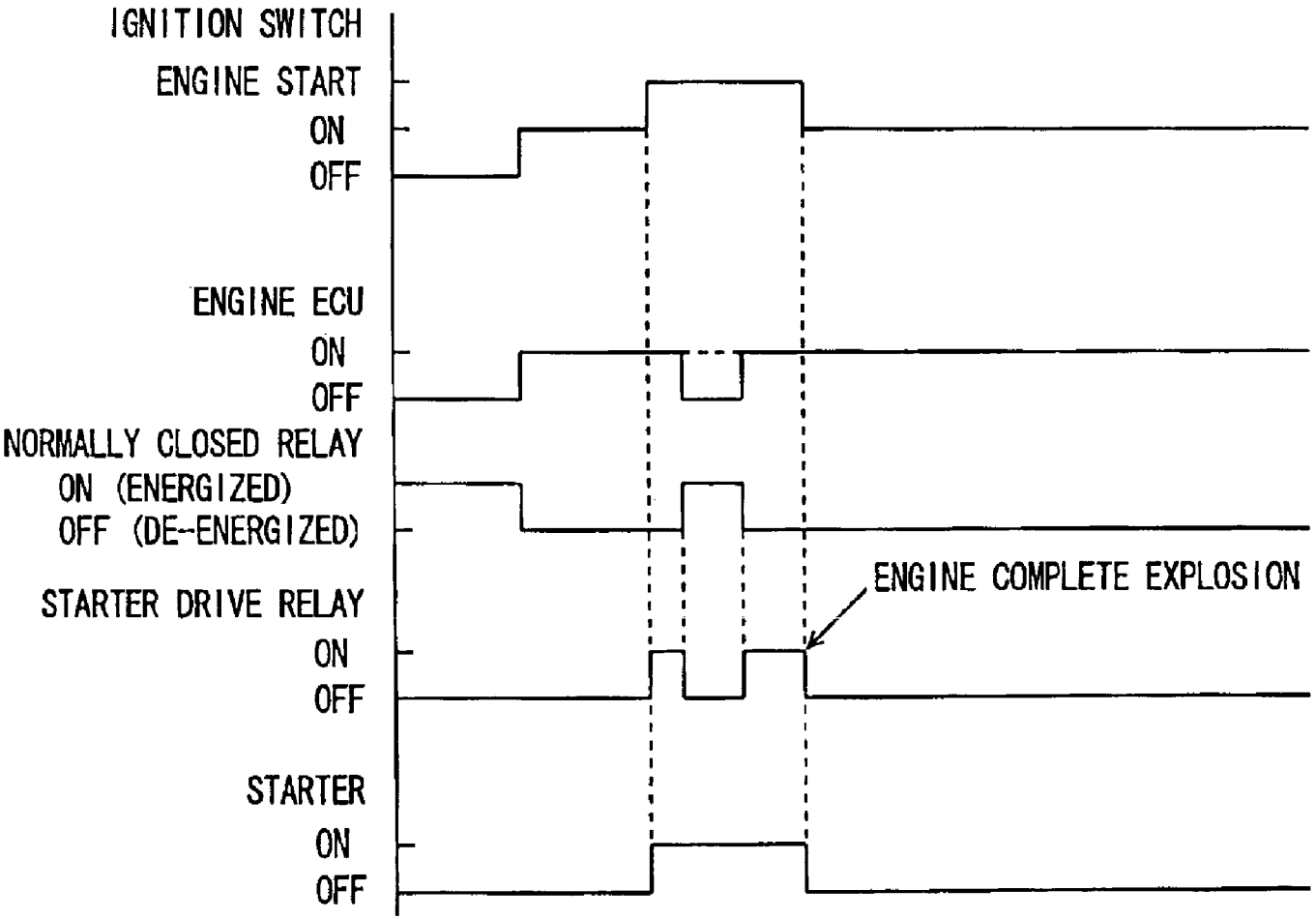
FIG. 4 is a timing chart for the engine start system in starting the engine, according to the first embodiment of the present invention.

Engine ECU 100 is thus energized (S102) and accordingly the exciting circuit of normally closed relay 400 is energized. Then, normally closed relay 400 enters the de-energized state (S104). More specifically, as shown in FIG. 4, simultaneously with the transition of engine ECU 100 from the off state to the on state, normally closed relay 400 changes from the on state to the off state to enter the de-energized state. When the ignition switch is turned to the engine start position (YES in S106), starter drive relay 300 enters the on state (S108).

Figure 3:
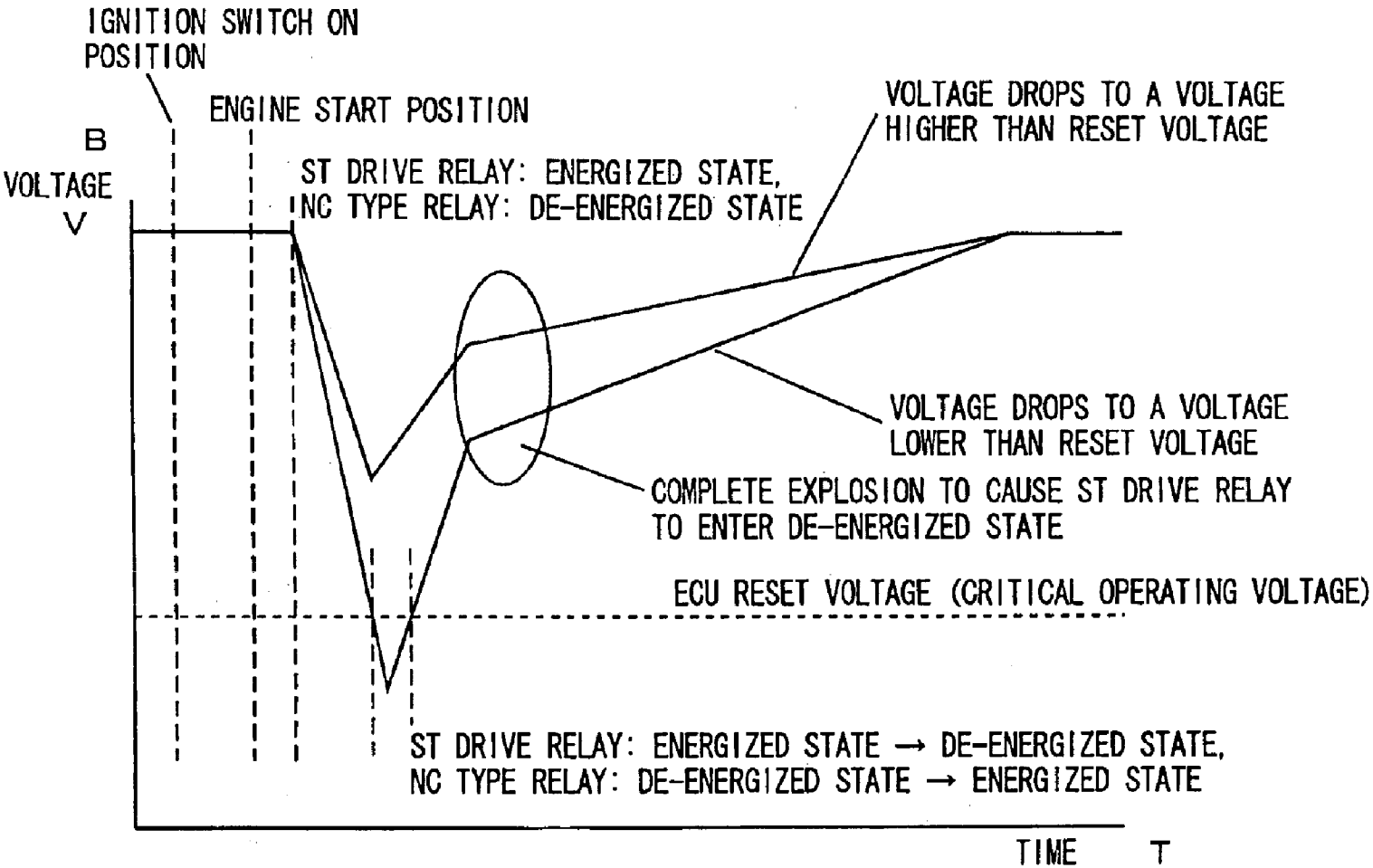
FIG. 3 shows a change in supply voltage to the engine ECU of the engine start system according to the first embodiment of the present invention.

At this time, as shown in FIG. 3, a great power is supplied from the battery to starter 600 so that the voltage supplied to engine ECU 100 temporarily decreases. When the voltage drops below the ECU reset voltage (critical operating voltage) shown in FIG. 3, the energization from engine ECU 100 to the exciting circuit of normally closed relay 400 is stopped. Then, as shown in FIG. 4, normally closed relay 400 enters the on state, i.e. energized state. Further, when the voltage supplied from the battery drops below the ECU reset voltage as described above, the energization from engine ECU 100 to the exciting circuit of starter drive relay 300 is stopped. Accordingly, starter drive relay 300 which has been in the on state temporarily enters the off state.

As described above, when the voltage supplied from the battery to engine ECU 100 is lower than the ECU reset voltage, starter drive relay 300 is in the off state, normally closed relay 400 is in the on state (energized) and starter switch 200 is in the on state. In this way, the voltage of the battery is supplied to starter 600 via starter switch 200 and normally closed relay 400 so that starter 600 is kept in the on state.

In this situation, the engine is cranked by starter 600, and then the engine inertia decreases so that the power supplied from the battery to starter 600 decreases. Accordingly, the voltage supplied from the battery to engine ECU 100 increases as shown in FIG. 3. When the supplied voltage becomes higher than the ECU reset voltage, engine ECU 100 which has temporarily been in the off state returns to the on state, as shown in FIG. 4. With this return, normally closed relay 400 is changed to the off state (de-energized) and starter drive relay 300 is changed from the off state to the on state. In other words, when the voltage supplied to engine ECU 100 becomes higher than the ECU reset voltage, energization from engine ECU 100 to the exciting circuit of normally closed relay 400 is resumed, so that normally closed relay 400 enters the off state (de-energized) while energization from engine ECU 100 to the exciting circuit of starter drive relay 300 is resumed. Thus, the power supply from the battery to starter 600 via engine ECU 100 is resumed.

When engine ECU 100 thereafter determines, based on an rpm input from engine rpm sensor 500, that the engine is in the complete explosion state (YES in S110), the energization to the exciting circuit of starter drive relay 300 is stopped (S112). Accordingly, starter drive relay 300 enters the off state and starter 600 enters the off state.

As discussed above, the engine start system according to this embodiment has the structure including a normally closed relay in addition to components of the conventional system. This normally closed relay is in the de-energized state when the engine ECU normally operates. When a voltage supplied from the battery to the engine ECU becomes lower than a threshold, the engine ECU temporarily stops to cause the normally closed relay to enter the energized state. As the normally closed relay is placed between the starter switch and the starter, the power of the battery can be supplied, in the event that the engine ECU does not function, to the starter via the starter switch and the normally closed relay. Consequently, an engine start control system can be provided at a low cost that is capable of normally starting the engine even when the computer of the engine start system is inoperative.

Second Embodiment

An engine start system according to a second embodiment of the present invention is now described. It is noted that any description which is common to the first and second embodiments and has already been given above is not repeated here.

Figure 5:
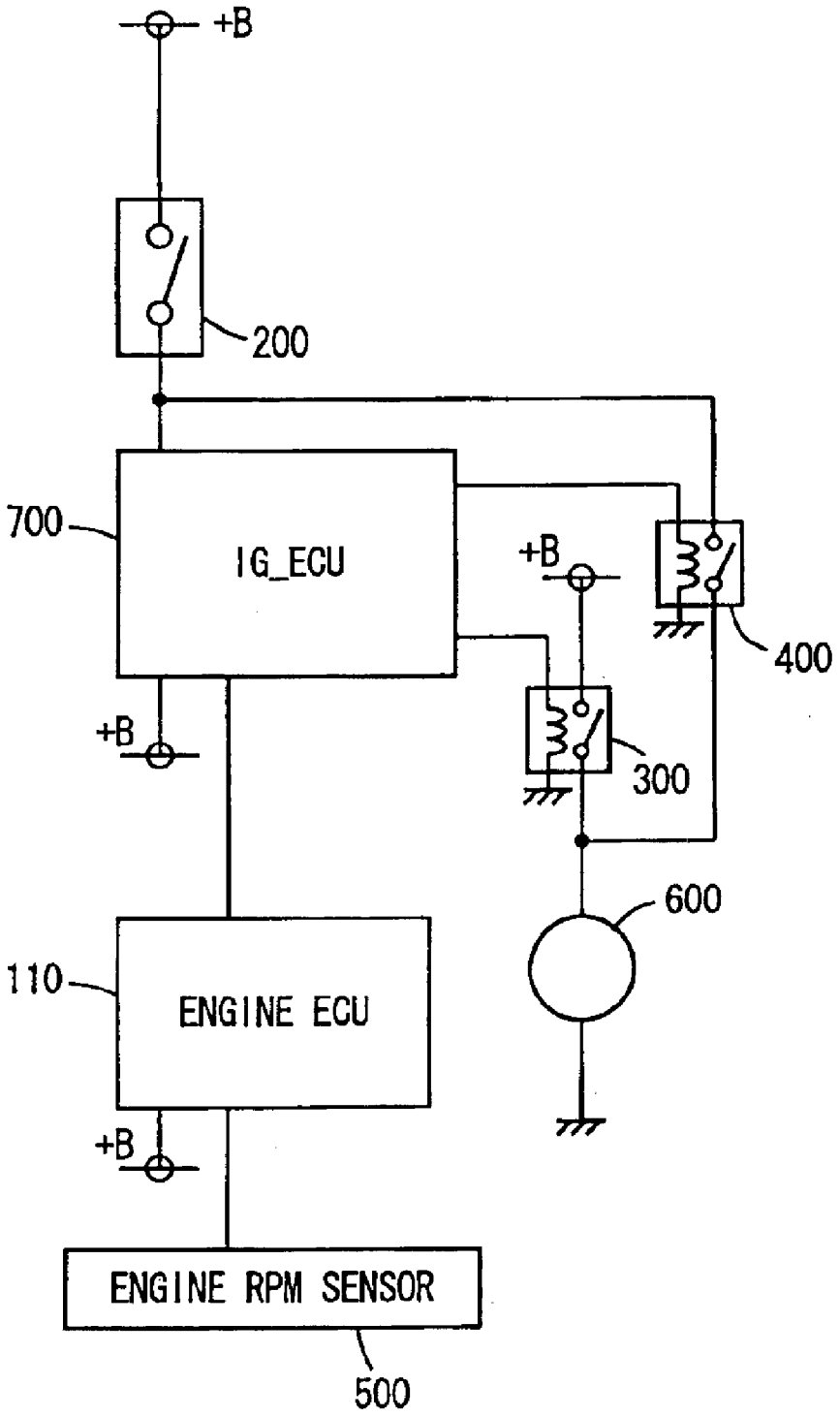
FIG. 5 is a control block diagram of an engine start system according to a second embodiment of the present invention.

Referring to FIG. 5, the engine start system according to this embodiment includes an IG_ECU 700 in addition to the components of the engine start system of the first embodiment shown in FIG. 1. IG_ECU 700 is connected to an engine ECU 110, and an engine rpm sensor 500 is connected to engine ECU 110. IG_ECU 700 and engine ECU 110 are both supplied with electric power from a battery. Further, IG_ECU 700 is connected to a starter switch 200, a starter drive relay 300 and a normally closed relay 400.

When the ignition switch is turned to the on position, IG_ECU 700 is supplied with electric power from the battery to start its operation. At this time, IG_ECU 700 energizes an exciting circuit of normally closed relay 400 so that the normally closed relay enters a de-energized state. When starter switch 200 is turned on, IG_ECU 700 energizes an exciting circuit of starter drive relay 300 in accordance with an engine start condition stored in an internal memory of IG_ECU 700. Upon the energization of the exciting circuit of starter drive relay 300, electric power is supplied to starter 600.

If IG_ECU 700 becomes inoperative in the start system of this embodiment, an operation is performed as described below. When the ignition switch is turned to the on position, electric power is supplied from the battery to IG_ECU 700. IG_ECU 700, however, does not normally operate so that it can neither energize the exciting circuit of starter drive relay 300 nor energize the exciting circuit of normally closed relay 400. Accordingly, starter drive relay 300 stays in a de-energized state and normally closed relay 400 stays in an energized state.

In this situation, when a driver of the vehicle turns the ignition switch to the start position (closes starter switch 200), electric power of the battery is supplied to starter 600 via starter switch 200 and normally closed relay 400 and accordingly starter 600 rotates to crank the engine. The engine starts rotating in this state, and then the driver senses the rotation to release starter switch 200 which is a momentary-on contact. Accordingly, the power supply from the battery to starter 600 stops, which causes starter 600 to stop. The process of starting the engine is thus completed.

As heretofore discussed, with the engine start system according to this embodiment, even if IG_ECU 700 controlling start of the engine in a vehicle having this IG_ECU 700 installed therein in addition to the engine ECU is completely inoperative, the engine can normally be started as a normally closed relay is installed.

It is to be understood that, the embodiments herein disclosed are by way of illustration and example only in every respect and are not to be taken by way of limitation. The present invention is defined by the claims, not by the description above, and it is intended that the present invention covers all modifications within the meaning and scope equivalent to those of the claims.

INDUSTRIAL APPLICABILITY

As discussed above, the engine start control device of the present invention having the simple structure can start the engine even in an unexpected event that the engine ECU does not normally operate. The engine start control device of the present invention, therefore, is appropriate for all of the vehicles that require the engine which is a drive source to start even if an unexpected event occurs.

What is claimed is:

1. An engine start control device comprising:

a motor for starting an engine of a vehicle;

a motor control relay making a switch between supply and stop of electric power to said motor; and a control circuit connected to an engine starter switch and controlling opening/closing of said motor control relay based on a predetermined start condition, wherein said start control device includes a normally closed relay connected to said engine starter switch, said control circuit and said motor, establishing a de-energized state between said engine starter switch and said motor upon energization from said control circuit to an exciting coil and establishing an energized state between said starter switch and said motor upon de-energization of the exciting coil, and said control circuit includes control means for exercising control, based on a predetermined condition, to energize the exciting coil of said normally closed relay.

2. The engine start control device according to claim 1, wherein said control circuit enters an inoperative state when a voltage supplied from a power source installed in the vehicle drops below a predetermined voltage, and accordingly energization from said control circuit to said exciting coil is stopped.

3. The engine start control device according to claim 1, wherein said control circuit includes means for exercising control to energize the exciting coil of said normally closed relay upon satisfaction of a condition that supply of electric power from a power source installed in the vehicle to said control circuit is started.

4. The engine start control device according to claim 1, wherein a switching circuit of said engine starter switch is closed so long as force is applied to the switch.

5. The engine start control device according to claim 1, wherein said normally closed relay is incorporated in said control circuit.

6. An engine start control method of an engine start control device including a motor for starting an engine of a vehicle, a motor control relay making a switch between supply and stop of electric power to said motor, a control circuit connected to an engine starter switch and controlling opening/closing of said motor control relay based on a predetermined start condition, and a normally closed relay connected to said engine starter switch, said control circuit and said motor, establishing a de-energized state between said engine starter switch and said motor upon energization from said control circuit to an exciting coil and establishing an energized state between said starter switch and said motor upon de-energization of the exciting coil, and said start control method comprising the step of exercising control, based on a predetermined condition, to energize the exciting coil of said normally closed relay.

7. The engine start control method according to claim 6, wherein said control circuit enters an inoperative state when a voltage supplied from a power source installed in the vehicle drops below a predetermined voltage, and accordingly energization from said control circuit to said exciting coil is stopped.

8. The engine start control method according to claim 6, wherein said step of exercising control to energize the exciting coil includes the step of exercising control to energize the exciting coil of said normally-closed relay upon satisfaction of a condition that supply of electric power from a power source installed in the vehicle to said control circuit is started.

9. The engine start control method according to claim 6, wherein a switching circuit of said engine starter switch is closed so long as force is applied to the switch.

10. A recording medium having a program recorded thereon for allowing a computer to implement the start control method recited in claim 6.

11. The engine start control device according to claim 2, wherein said control circuit includes means for exercising control to energize the exciting coil of said normally closed relay upon satisfaction of a condition that supply of electric power from a power source installed in the vehicle to said control circuit is started.

12. The engine start control device according to claim 2, wherein a switching circuit of said engine starter switch is closed so long as force is applied to the switch.

13. The engine start control device according to claim 2, wherein said normally closed relay is incorporated in said control circuit.

14. The engine start control method according to claim 7, wherein said step of exercising control to energize the exciting coil includes the step of exercising control to energize the exciting coil of said normally-closed relay upon satisfaction of a condition that supply of electric power from a power source installed in the vehicle to said control circuit is started.

15. The engine start control method according to claim 7, wherein a switching circuit of said engine starter switch is closed so long as force is applied to the switch.

16. A recording medium having a program recorded thereon for allowing a computer to implement the start control method recited in claim 7.

* * * * *